US006075244A

United States Patent [19]

Baba et al.

[11] Patent Number: 6,075,244

[45] Date of Patent: Jun. 13, 2000

[54] MASS SPECTROMETER

[75] Inventors: Takashi Baba, Higashimatsuyama; Izumi Waki, Asaka, both of Japan

[73] Assignee: Hitachi, Ltd., Tokyo, Japan

[21] Appl. No.: 08/983,212

[22] PCT Filed: Jul. 3, 1995

[86] PCT No.: PCT/JP95/01322

§ 371 Date: Jan. 5, 1998

§ 102(e) Date: Jan. 5, 1998

[87] PCT Pub. No.: WO97/02591

PCT Pub. Date: Jan. 23, 1997

[51] Int. Cl.[7] ..... B01D 59/44; H01J 49/00

[52] U.S. Cl. ..... 250/292; 250/281

[58] Field of Search ..... 250/281, 288, 250/292

[56] References Cited

U.S. PATENT DOCUMENTS 3,629,573 12/1971 Carrico et al. ..... 250/292
4,755,670 7/1988 Syka et al. ..... 250/292
5,179,278 1/1993 Douglas ..... 250/292
5,420,425 5/1995 Bier et al. ..... 250/292
5,521,382 5/1996 Tanaka et al. ..... 250/292
5,598,001 1/1997 Flory et al. ..... 250/292
5,679,950 10/1997 Baba et al. ..... 250/292
5,783,824 7/1998 Baba et al. ..... 250/292

*Primary Examiner*—Bruce C. Anderson
*Attorney, Agent, or Firm*—Antonelli, Terry, Stout & Kraus, LLP

[57] ABSTRACT

A method of performing a high sensitivity mass analysis is described wherein a plurality of linear quadrupole radio frequency electrodes are aligned, and operated as a mass filter or an ion trap mass analyzer. A background ion removal filter having a linear quadrupole electrode structure may also be connected in cascade to this mass analyzer if necessary. The background ion removal filter powerfully removes background ions so as to improve analytical sensitivity. This mass spectrometer also makes it possible to prevent losses of minute amounts of sample ions in the ion trap, prevent destruction of minute amounts of ions and reduce contamination of the ion trap electrodes.

26 Claims, 13 Drawing Sheets

MASS SPECTROMETER

FIELD OF THE INVENTION

This invention relates to a mass spectrometer realizing high sensitivity mass analysis by combining a linear ion trapping mass spectrometer and a linear mass filter.

BACKGROUND OF THE INVENTION

In radio frequency ion trap technology, a three-dimensional ion trapping using a radio frequency quadrupole field (so called Paul trap), and a linear ion trapping using a two-dimensional radio frequency quadrupole field and (a direct current voltage are known. This Paul trap comprises a ring electrode, and two end cap electrodes facing toward the hole in the ring. A radio frequency voltage is applied between the ring electrode and two end cap electrodes so as to generate a 3-dimensional radio frequency quadrupole electric field between the electrodes in which ions accumulate.

A description of this method of accumulating ions is given for example in H. G. Dehmelt, Adv.At.Mol.Phys. 3, 53 (1967).

As shown for example in U.S. Pat. No. 4,755,670 (1988), M. G. Raizen et al: Phys. Rev. A45, 6493 (1992), and J. D. Prestage et al: J. Appl. Phys. 66 1013 (1989), a linear quadrupole radio frequency electric field is generated in the vicinity of the center of the electrodes by applying a radio frequency electric field to the linear quadrupole electrode structure such that the electrodes on opposite sides have the same phase, and ions are thereby stably trapped in the direction perpendicular to the long axis of the electrodes. However, in this situation, ions leak from the ends of the electrodes. This is prevented by applying a direct current voltage having the same polarity of the trapped ions to the ends of the electrodes.

One field of application of ion trapping technology in industry is that of mass spectrometry. A mass spectrometer using a Paul trap, i.e. an ion trap mass spectrometer, is introduced in U.S. Pat. No. 2,939,952 invented by Paul et al in 1960. However, at that time an effective operation method for mass spectrometry was not given, and due to its low resolution and narrow mass range for mass analysis, it did not lead to its practical use as a mass spectrometer. When the operating method disclosed in U.S. Pat. No. 4,540,884, "mass selective instability", was invented, the device reached a practical level of mass range, detection sensitivity and detection resolution. However, mass spectrometry devices using linear ion trapping are not currently in practical use. A method of using these devices for mass spectrometry was suggested in U.S. Pat. No. 4,755,670 (1988). According to this method, the ions which accumulate in the trap are made to resonate in a mass-dependent oscillation mode, and the oscillation is detected electrically. Considering the induced signal strength, it may be expected that the sensitivity will be low. An example of a mass-analyzing function of a curved linear ion trap with an external ion detector is given by Waki et al in Physical Review Letters, Vol. 68, page 2007–2010 (1992), where the ion detector detects trapped ions that have been elected perpendicularly to the center axis of the trap after undesired ions are ejected using mass-selective instability. A similar configuration with other types of linear traps in combination with aforesaid techniques used in Paul traps is described by Bier et al in U.S. Pat. No. 5,420,425 (1995).

When one attempts to improve the sensitivity of the mass spectrometry device using the Paul trap which is now being put to practical use, an adverse effect appears due to background ions. In other words, the detection sensitivity of ions to be detected deteriorates when there is a large amount of background ions. This effect must therefore be removed. One method of doing this is the method of operating an ion trap mass spectrometer introduced, for example in U.S. Pat. No. 5,134,286. Therein it is proposed that background ions are mass-selectively ejected during injection of ions into the ion trap and in the stage prior to performing mass analyzing. However, according to this method, there are following disadvantages in removing the background ions in the ion trap while they are brought to resonance by supplying them with energy, which interferes with a high sensitive analysis. Firstly, during background ion removal, background ions which are brought to resonance collide with out of the trap electrodes. Secondly, background ions having a large kinetic energy collide with sample ions that are trapped, and the sample ions are thereby destroyed. Thirdly, the ion detector and the trap electrodes are contaminated by the large amount of background substances, and detection sensitivity and mass resolution fall.

To deal with these problems, the background ions may be removed using a mass filter before they enter the ion trap. One example of this is disclosed in, for example, K. L. Morand et al: International Journal of Mass Spectrometry and Ion Processes 105 13 (1991). This prior art example describes a mass spectrometer wherein a mass filter is connected in cascade with a mass analyzer comprising essentially a Paul trap. After the mass filter has removed background ions to increase the purity of the sample ions, the sample ions enter a hole in an end cap electrode of the Paul trap, and accumulate in the trap. The ions are then analyzed in the mass analyzer. According to this prior art, the ions trapped in the mass analyzer contain almost no background. Therefore, loss or destruction of ions to be detected due to collisions with background ions is suppressed. Further, there is no contamination of the ion trap electrodes and the ion detector by background ions.

However, this mass spectrometer comprising a mass filter and a mass analyzer comprising essentially a Paul trap has a disadvantage that, as the ion trapping efficiency is low, it is difficult to obtain higher sensitivity. This is due to the fact that the mass filter has a linear construction whereas the Paul trap has a 3-dimensional construction. Specifically, a high kinetic energy must be given to the incident ions so that they can pass through the mass filter and into the Paul trap. The sample ions therefore can collide with the end cap electrode opposite to the entrance hole, and can be lost. To prevent this, the DC potential of the opposite electrode is increased, both potentials being restored after the ion injection so that the ions are trapped inside the trap. This causes an intermittent ion injection. Hence, the number of sample ions which can be trapped on each mass analysis operations is low and the sensitivity cannot be improved. Another possible method is to slow down the ions by collision with a gas so that they are stopped inside the ion trap. In general, an ion trap mass spectrometer is set in a helium gas environment ranging from $10^{-1}$ to $10^{-6}$ Torr so as to improve the sensitivity. It might be thought that this helium gas could be used to stop the ions with high frequency. However, it is difficult to efficiently stop sample ions, that have passed through the mass filter with high kinetic energy, using dilute gas.

DISCLOSURE OF THE INVENTION

The present invention cascades a mass filter and a mass analyzer. The cascade configuration is similar to the mass spectrometer described in the International Journal of Mass Spectrometry and Ion Processes: Vol. 105 (1991), p. 13. However, the present invention adopts a linear ion trap as the mass analyzer, which differs from the prior art significantly; i.e. sample ions from which background ions have been removed in the mass filter can be transferred to the mass analyzer continuously with high efficiency. Another feature of this invention is an effective method of using the linear ion traps of this invention to perform high sensitive mass analysis.

Hence, according to this invention, firstly, a mass filter and a mass analyzer are cascaded and both have a linear quadrupole structure. The mass filter and a linear ion trap of the mass analyzer are joined together coaxially. The electrode structure of the linear ion trap used in this invention may be that of the linear ion trap of the electrodes with a quadrupole structure disclosed in the aforesaid U.S. Pat. No. 4,755,670 or M. G. Raizen et al: Phys. Rev. A45, 6493 (1992), which uses a quadrupole structure also for end electrodes. By arranging both the mass filter and the mass analyzer to have the same quadrupole electrode structure in this way, the two join exceedingly well to achieve a high efficiency. That is, since the mass filter is connected directly with the mass analyzer in series, an electrical lens is not needed. Moreover, if the end electrodes are arranged to have the same quadrupole electrode structure as that of the mass analyzer, there is no electrode on the center axis of the end electrode in the linear ion trap of the mass analyzer. Therefore, ions on the center axis do not collide with the electrode and are not lost. As a result, ions which have passed through the mass filter can be guided to the ion trap of the mass analyzer unit with high efficiency without the use of a lens.

In the above arrangement, the electrode structure comprises the mass filter unit, the mass analyzer unit and the end electrode unit arranged in cascade. Mass analysis is performed by interfacing the mass filter to an ion source of, for example, any one of various external ion sources used in conventional quadrupole mass analysis apparatus of prior arts. This arrangement is described in Embodiment 1.

In addition to this fundamental electrode structure, one can further take advantage of the linear quadrupole nature by using an ion source of a quadrupole structure and by placing end electrode units to both ends of a linear structure in which an ion source unit, a mass filter unit, and a mass analyzer unit are directly connected in cascade. By setting the electrical potential of these two end electrode units to a value equal to or greater than the potential of the ion source unit, ions shall be confined within the space defined by the electrodes of the linear ion trap structure. In this case, it is unnecessary to vary the voltage of the ion trap electrodes in order to introduce ions into the mass analyzer unit, which would be necessary in a Paul trap structure. Hence, ions may be injected into the ion trap continuously without ion loss. Such an arrangement is described in Embodiment 2.

When high sensitive mass spectrometry is performed on minute sample, the amount of background ions to be removed would increase both in the total number and the number of ion species, resulting in the need for a more efficient method of removing background ions. In this case, in order to get full performance of the high resolution and analyzing power of the mass filter, the quantity of ions sent into the mass filter must be reduced as much as possible. To this purpose, one must add additional units which remove background ions more effectively. According to this invention, since the fundamental electrodes have linear quadrupole structure, it is easy to connect a plurality of additional filter units each having an exclusive function of removing specific ions species. An example of a mass spectrometer comprising multiple filters is described in Embodiment 3.

As mentioned hereinabove, one method known in the art of removing specific ions in an ion trap devices is the method described, for example, in U.S. Pat. No. 5,134,286. According to this removal method, a disadvantage in that ions to be detected are lost by collision with background ions. However, according to another embodiment of our invention, this problem is resolved by applying an AC voltage which coincides with the resonance frequency of the background ions, where relative phases of the applied voltages to neighboring electrodes of the four electrodes comprising the quadrupole structure differ by one quarter of the oscillation period of the voltage. That is, the phase increases successively by a quarter wave in either clockwise or counterclockwise direction among the four electrodes, thereby ejecting the background ions from the electrode area by giving them a spiral motion. Because the background ions which have a spiral motion do not pass through the electrode center, the ejecting background ions do not collide with sample ions which have accumulated near the electrode center. An example of a mass spectrometer comprising a filter which removes specific background ions by this method is described in Embodiment 3.

In the aforementioned U.S. Pat. No. 4,755,670, one pair of facing electrodes is kept at round potential, and a radio frequency voltage is applied to the other set of electrodes. However, according to the embodiments of our invention, a different method of applying a radio frequency voltage from that of the aforesaid prior art must be used. According to these embodiments, the quadrupole radio frequency voltages applied to each unit of electrode structures such as the mass analyzer unit, mass filter units and other linear quadrupole electrode units are such that the electrode center is effectively at an electrostatically ground potential, so that the radio frequency voltage, to which the ions are subject at the center of the electrodes, is far less than their kinetic energy. Due to this effect, when the ions pass through various cascaded units which generally have different radio frequency amplitudes, ions moving through the centers of the electrode units are no longer sensitive to the differences in amplitudes and phases of radio frequency voltages in the travel direction. In other words, the ions can move smoothly from the ion source unit towards the mass analyzer unit. The radio frequency voltages which are applied to two pairs of electrodes—where each pair consists of two electrodes arranged in diagonally opposite positions with respect to the quadrupole axis—have the same amplitude and frequency but are 180° phase-shifted relative to each other, although an amplitude of a quadrupole unit can nevertheless vary from an amplitude of another unit. Due to this arrangement, the radio frequency amplitude at the electrode center axis can be ignored compared with the kinetic energy of the ions.

As stated hereinabove, an advantage of high sensitivity is gained by connecting a linear ion trap with a mass filter. Aforementioned previous examples of mass analysis methods using linear ion traps, however, do not address problems specifically associated with the linear configuration that prevents improvement of sensitivity. Herein, we disclose some methods for performing high sensitivity ion trap mass analysis using a linear ion trap.

A first method of performing a high sensitivity mass analysis using a linear ion trap is used in combination with a technique referred to hereafter as a mass selective resonant instability mode, which is widely used in Paul traps. In this mode, accumulated ions oscillate pseudo-harmonically inside the ion trap. This oscillation is called secular motion, and its frequency depends on the ion mass. An auxiliary external AC electric field is applied to the trapped ions, while the frequency of the AC electric field is scanned. When the external AC frequency coincides with the secular motion frequency of the trapped ions, the amplitude of these ions increases while they are on resonance. When this amplitude eventually increases so as to extend beyond the ion trap electrodes, the ions are ejected outside the electrodes. Mass analysis can then be performed by detecting the ions which are ejected outside the ion trap while performing frequency scan and mass selection as described above.

In this mass selective resonant instability mode, however, as the amplitude of the ions gradually increases due to resonance oscillation, there is a high possibility that the kinetic energy of the ions exceeds the depth of the pseudo-potential on the side where there is no detector. With 50% probability, ions would be ejected to that side without being detected, and henceforth, stable and high sensitive ion detection would no longer be possible. According to our invention, a dipole electrostatic field is therefore applied such that there is a higher potential on the side where there is no ion detector compared to the side where there no ion detector compared to the side where there is an ion detector. As a result, ions are ejected nearly 100% to the side where there is an ion detector.

In order to implement this invention, that determines the ejection direction, with the mass selective resonant instability mode, there are two methods, in which necessary components are added to the linear ion trap composing the mass analyzer unit.

In one method, the ejection direction is determined using following components: an AC circuit which is used to apply a dipole AC voltage between two pairs of neighboring electrodes of the four electrodes composing the ion trap unit which generates a dipole AC field between the electrodes; a DC circuit which is used to apply a DC voltage between said two electrode pairs which generates a dipole DC field between the electrodes; and an ion detector which detects ions which are ejected resonantly to the outside of the electrode unit by the AC field through a space between the electrodes. In this method, the ions are elected from a gap between the electrodes of the linear ion trap electrode unit.

In another method, the election direction is determined using following components: an AC circuit which is used to apply an AC voltage to one pair of opposite electrodes of the four electrodes composing the ion trap unit which generates a dipole AC field between the electrodes; a DC circuit which is used to apply a DC voltage between the electrodes to which the aforesaid AC voltage is applied so as to generate a dipole DC field between the electrodes; holes in one electrode for ejecting ions which are resonantly oscillated by the AC field to the outside of the electrode unit; and an ion detector for detecting the ions which are made to resonantly oscillate and which are ejected from said holes. In this method, the ions are ejected from the holes provided in the electrode.

Another common technique of performing high sensitivity mass analysis using an ion trap is the technique of mass selective instability as mentioned in the discussion of the prior art hereinabove. When mass selective instability is performed by a Paul trap, the amplitude of the applied radio frequency voltage is scanned from lower amplitude to higher amplitude, and the ions which are unstable are ejected only in the Z axis direction, because of the asymmetry between Z direction and X-Y directions. However, in a linear ion trap, because the applied field is symmetrical in the X and Y directions, most of the ions collide with the electrodes when the ions become unstable during the mass scanning. The probability of ions entering the detector is therefore very small, and this lowers the ion detection efficiency. In our invention, to avoid the disadvantage, a suitable magnitude of a quadrupole DC voltage is applied to the electrodes. Due to this additional function, the ejected ions are constrained in a desired direction. Therefore, ion detection efficiency can be improved. To implement the aforesaid mass selective instability mode in a linear ion trap, the linear ion trap which composes the mass analyzer unit must have the following functions. Firstly, the radio frequency voltage circuit must have a scanning function so as to scan the radio frequency amplitude applied to the linear ion trap electrodes. A DC voltage device must be provided to apply a quadrupole DC voltage to the linear ion trap. An ejecting hole must be provided in one electrode of the quadrupole electrodes so that ions are ejected outside the electrode unit. Finally, an ion detector must be disposed facing the ejecting hole so as to detect the ejected ions.

Next, methods for providing the ion ejecting hole in a quadrupole electrode will be described, which is required in one of aforementioned implementation of mass resonant ejection methods and in the aforementioned mass selective instability method. To improve the ion capture efficiency, the hole should be as large as possible. However, if the hole is made too large, the radio frequency field and the DC field (if it is necessary to apply one) are distorted, causing a departure from an ideal quadrupole field and lowering the resolution of the mass analysis. A means must therefore be devised to increase the hole surface area while making an effort to suppress the field distortion within an allowable level, although these requirements are mutually conflicting.

One method of forming an ejecting hole in an electrode is to provide one hole or a plurality of holes on a linear electrode, oriented in the direction of the long axis facing the center axis of the ion trap. In the case of a plurality of holes, one or more slits of narrow width may be arranged in a linear row upon a part of the electrode surface nearest to the center axis of the ion trap. Alternatively, a plurality of rows of slits may be aligned so as to cover the electrode surface and thereby increase the total hole area. By these methods, field distortion can be suppressed while obtaining a large hole area.

A second method of forming an ion ejecting hole in an electrode is to form the whole electrode surface by a mesh made of a conductor. By forming the electrode with a mesh comprising fine holes, field distortion may be suppressed even more than in the first method described hereinabove.

A third method of forming a removal hole in an electrode is to lay a plurality of fine conducting wires on a conducting frame. When the conducting wires are laid on the frame, the plane containing the plurality of conducting wires has to be essentially the same shape as that of the other electrodes.

PREFERRED EMBODIMENTS OF THE INVENTION

A preferred embodiment of this invention will now be described.

Figure 1:
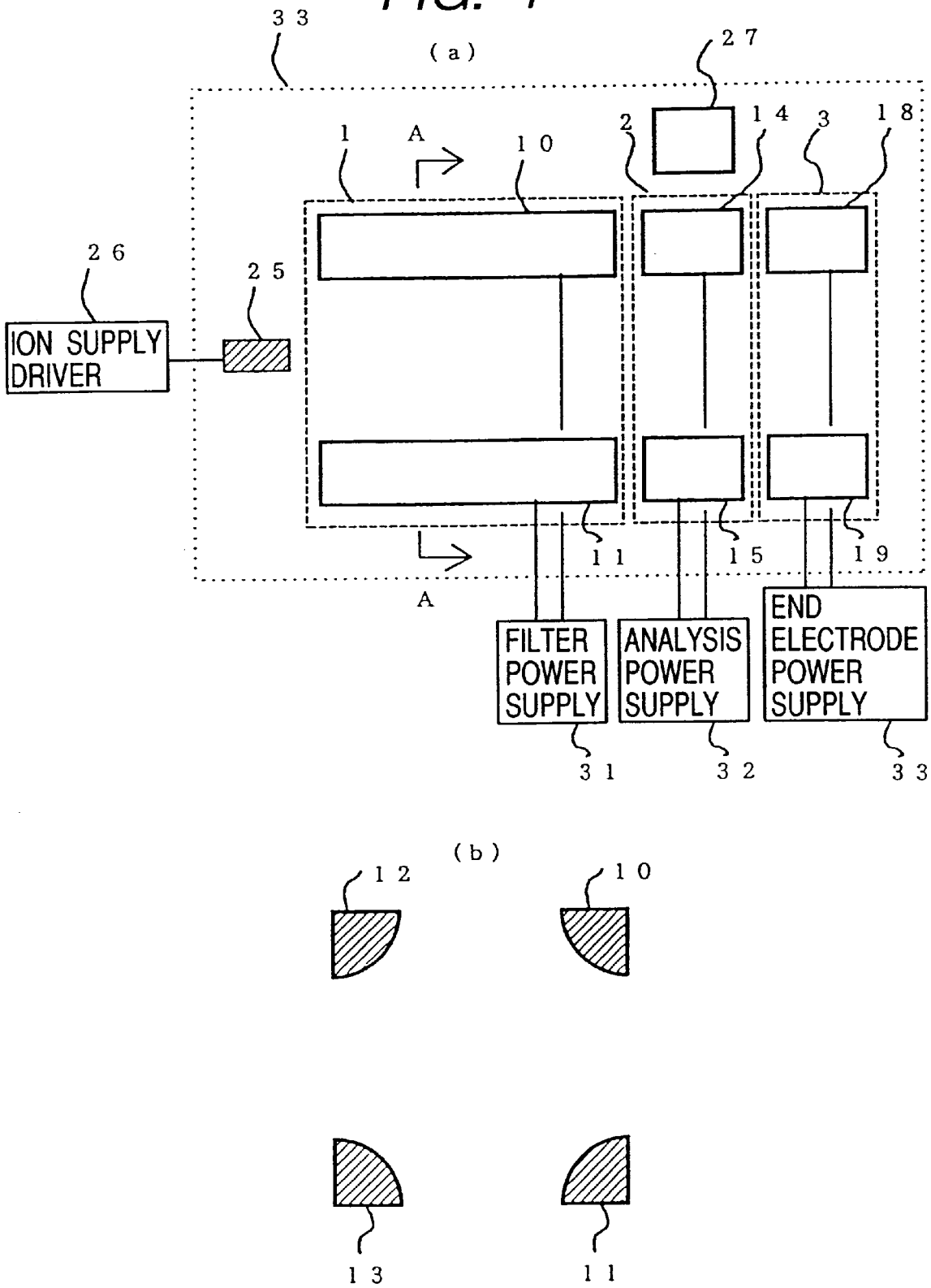
FIG. 1(*a*) is a schematic view of a first embodiment of a mass spectrometer according to this invention, and FIG. 1(*b*) is a section of a linear quadruple electrode in FIG. 1(*a*) viewed in the direction of an arrow at a position A—A along a line A—A.

FIG. 1 shows one form of the mass spectrometer according to this invention. This figure shows an example of the resonance oscillation mode as the mass spectrometric technique, but it may be implemented also by the mass selective instability mode. An example of the mass selective resonant instability mode is shown in the fourth embodiment.

According to this embodiment, as shown in FIG. 1(*a*), a mass filter unit 1, a mass analyzer unit 2 and an end electrode unit 3 are arranged, in a vacuum chamber 33, in cascade so that they all lie on a center axis. The mass filter unit 1, the mass analyzer unit 2 and the end electrode unit 3 each have four electrodes, although only two of each unit, i.e. 10, 11, 14, 15, 18 and 19 are shown in the figure. A suitable filter power supply 31, an analyzing power supply 32 and an end electrode power supply 33 are connected to each of these electrodes, so that each unit will function as required. An ion detector 27 is disposed adjacent to the mass analyzer unit 2 for detecting ions which are ejected from the mass analyzer unit 2. An ion source device 25 for ionizing a sample to be analyzed is placed adjoining the mass filter unit 1 on the side opposite to the mass analyzer 2. The ion source device 25, which ionizes the sample, is driven by a suitable ion source driver 26. A feature of this embodiment is that a variety of ion sources used in conventional mass spectrometers may also be used herein.

FIG. 1(*b*) shows one example of the arrangement of electrodes in the mass filter unit 1, the mass analyzer unit 2 and the end electrode unit 3. As shown in the figure, four rod electrodes 10, 11, 12, and 13 are aligned parallel to the long axis of the rods so that their cross-sections lie at the four corners of a square. The rods are manufactured so that their cross-sections are hyperbolic so that the radio frequency electric field formed along the center of the four rods is a quadrupole radio frequency field. The electrode surfaces are gold-plated, if necessary, to prevent deterioration due to oxidation.

As stated hereinabove, the electrodes of the mass filter unit 1, the mass analyzer unit 2 and the end electrode unit 3 are arranged so as to lie on straight lines, and voltages of identical phase are applied to the electrodes on the same line. Adjacent electrodes must be electrically insulated from each other by inserting gaps or insulators. However, since the insulation between units destroys electrical continuity between adjacent units, the radio frequency field inside the mass filter unit 1, the mass analyzer unit 2 and the end electrode unit 3 would be affected and its uniformity would be destroyed. This in turn interferes with the motion of ions along the direction of the center axis. It is therefore necessary to make the gaps between the units to be substantially less than a distance $r_0$ between the quadrupole electrodes, as defined in FIG. 2, to avoid this effect as much as possible. The length of each unit of the structure should be substantially greater than $2r_0$. It is also necessary to use the same sets of methods and materials to wire each of the electrodes to other components. This is due to the potential difference, referred to as a contact potential, which occurs when metals of different type come in contact with each other. If the methods and materials used to wire different electrodes are not exactly the same, unexpected potential differences can appear between the electrodes. This means that the potential of the electrodes can differ from the DC voltage that one planned to apply, and introduces unknown factors into the detector performance.

To operate the mass filter unit 1 and the ion trap mass analyzer unit 2 in cascade, the operating voltage of each units should be determined as described below. It is also necessary to determine the resonance frequency of ions to be detected as described below. An outline of the basic principles and equations required to implement this invention is shown below.

Figure 2:
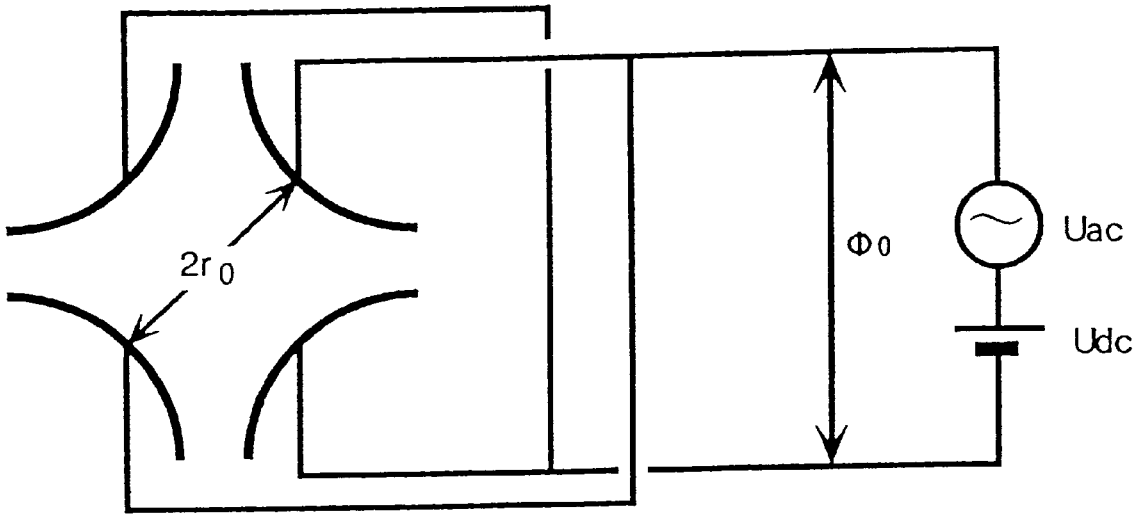
FIG. 2 is a diagram showing operating parameters describing the principle of an RF quadrupole linear ion trap.

As shown in FIG. 2, the distance between electrodes is expressed by $r_0$. Two electrodes of each pair, which are facing opposite to each other with regard to the quadrupole axis, are connected together. When a radio frequency voltage having amplitude Uac and angular frequency Ω and a DC voltage Udc are applied between pairs of connected electrodes of the quadrupole electrode unit, the applied field inside the electrodes is given by Eqn. (1).

$$\left.\begin{aligned}\Phi_{(x,y,z,t)} &= \Phi_{o(t)}x^2 - \frac{y^2}{2r_0^2}\\ \Phi_{0(t)} &= U_{dc} - U_{ac}\cos\Omega t\end{aligned}\right] \quad \text{(Equation 1)}$$

The equation of motion of a charged particle having a charge Q and mass m in this potential field, is given by Eqn. (2).

$$\left.\begin{aligned}&\frac{d^2x}{dt^2}+\frac{Q\Phi_0}{m2r_0^2}=0\\&\frac{d^2y}{dt^2}-\frac{Q\Phi_0}{mr_0^2}y=0\\&\frac{d^2z}{dt^0}=0\end{aligned}\right]\quad\text{(Equation 2)}$$

To make this equation dimensionless, the time t and applied voltages Uac, Udc are normalized so as to obtain Eqn. (3).

$$\left.\begin{aligned}&\xi=\frac{\Omega t}{2}\\&a_1=-a_2=\frac{4QU_{dc}}{m\Omega^2r_0^2}\equiv a\\&q_1=-q_2=\frac{2QU_{ac}}{m\Omega^2r_0^2}\end{aligned}\right]\quad\text{(Equation 3)}$$

Using Eqn. (3), if x, y are written respectively as $r_1$, $r_2$, Eqn. (2) may be written in the form of Eqn. (4).

$$\frac{d^2r_i}{d\xi^2}+(a_i-2q_i\cos 2\xi)r_i=0\quad\text{(Equation 4)}$$

$$(i=1,2)$$

This is the well-known Matthew equations.

Figure 3:
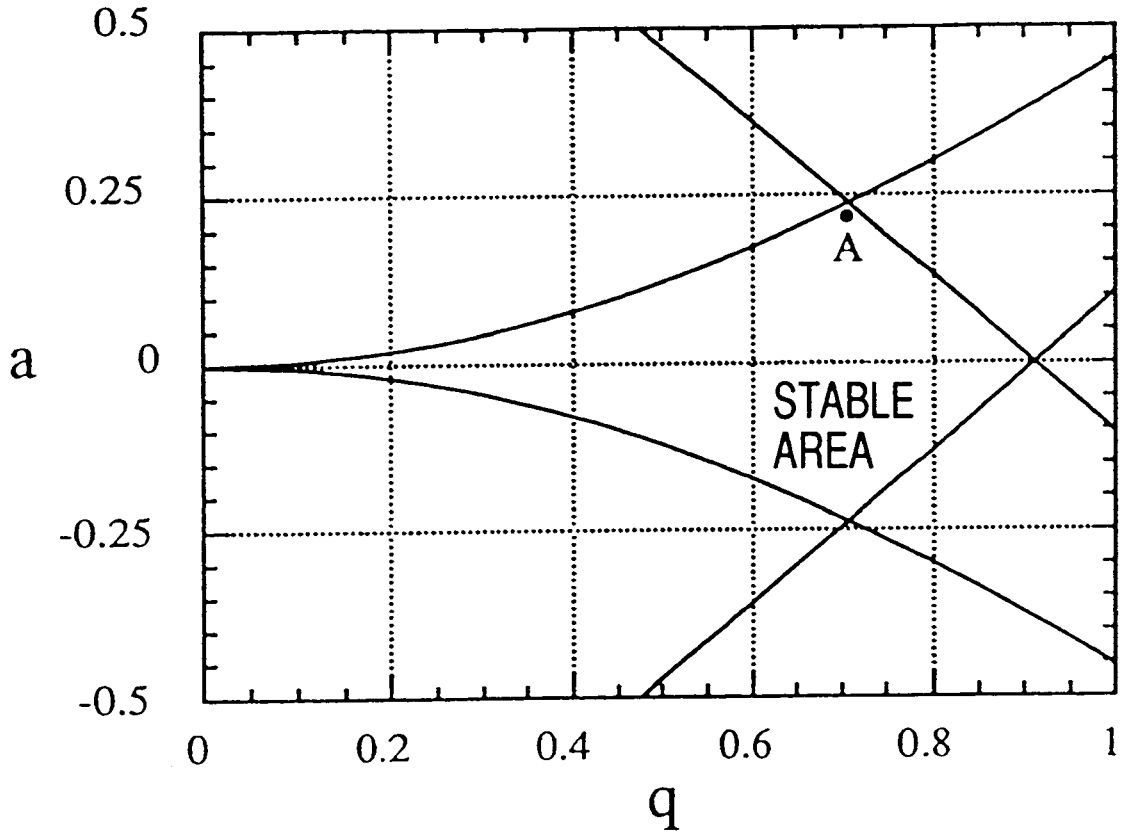
FIG. 3 is a diagram showing an envelope of a stable area of the linear ion trap shown in FIG. 2.

The solution of this differential equation can be either a stable solution or an unstable solution according to the values of the parameters a and q. In the case of a linear ion trap, ions are constrained in the x, y direction, whose stable area is shown in FIG. 3.

Since the general solution to Matthew's equation is complex, a pseudo-potential method is applied, which is effective in discussing average motion of charged particles in non-uniform radio frequency fields. The motion of the ions may be expressed as r(t)=<r(t)>+ξ(t). Hereafter, the symbols <> represent a time average taken over a time 1/Ω. Herein, ξ(t) is given by Eqn. (5).

$$\left.\begin{aligned}&\zeta(t)=-\zeta_0\cos\Omega t\\&\xi_0=\frac{QE_{o(Z)}}{m\Omega^2}\end{aligned}\right]\quad\text{(Equation 5)}$$

The oscillation frequency motion represented by ξ(t) is referred to as a micromotion. Using <r(t)>, the force to which the ions are subject on average may be represented by Eqn. (6).

$$\left.\begin{aligned}&\langle F_{(\langle r\rangle)}\rangle=-Q\frac{a}{\partial\langle r\rangle}\Psi_{(\langle r\rangle)}\\&\Psi_{(\langle r\rangle)}=\frac{QE_0^2(\langle r\rangle)}{4m\Omega^2}\end{aligned}\right]\quad\text{(Equation 6)}$$

Here, $\Psi_{(<r>)}$ is referred to as a pseudo-potential.

Applying the above to the case of a quadrupole electrode unit, the pseudo-potential is given by Eqn. (7).

$$\left.\begin{aligned}&\Psi_{(x,y)}=\frac{Q}{4m\Omega^2}\left[gradU_{ac}\frac{x^2-y^2}{2r_0^2}\right]^2=D\left(\frac{x^2-y^2}{r_0^2}\right)\\&D=\frac{QU_{ac}^2}{4m\Omega^2r_0^2}=\frac{1}{8}qU_{ac}\end{aligned}\right]\quad\text{(Equation 7)}$$

The oscillation motion due to this harmonic potential is known as a secular motion, and its frequency is given by Eqn. (8).

$$\omega=\frac{\Omega q}{2\sqrt{2}}\quad\text{(Equation 8)}$$

Herein, D is the depth of the pseudo-potential. The secular motion frequency is slower than the micro motion frequency Ω.

The operating principle of the mass filter is as follows, which is basically a band-pass mass-filter. For the ions that one desires to let pass through the mass filter unit 1 and introduce into the mass analyzer unit 2, one adjusts the parameters a and q (Eqn. (3)) to lie within a stable area in the vicinity of a point A in FIG. 3. For the ions that one desires to delete by ejecting out of the region defined by the guadrupoles, one adjusts the parameters a and cl (Eqn. (3)) to lie within an unstable area in FIG. 3.

In the mass analyzer unit 2, the mass selective resonant instability mode is performed. According to this method, specific ions are resonated and ejected by an AC field having the same oscillation frequency as the secular motion frequency shown in Eqn. (8). When an AC field is applied, ions having a secular motion frequency equal to this AC frequency resonate; their oscillation amplitude increases and they are ejected outside the electrodes. By detecting these ions, the presence of ions can be known, which have a mass-to-charge ratio corresponding to the frequency of the auxiliary AC field.

According to this embodiment, radio frequency voltages of identical amplitude but of reverse phase are applied to two pairs of electrodes in diagonally opposite positions of the quadrupole electrode structure, so that the center axis of the quadrupole electrode is at a ground potential. This method has following merit; even when the radio frequency amplitude or phase applied to the electrodes of each units of the mass spectrometer is different, the disturbance of the radio frequency voltage on the motion of the ions in the center of the electrodes may be ignored. As a result, the ions can move smoothly along the center of the electrode structure without being affected by the radio frequency voltage difference between units.

Figure 4:
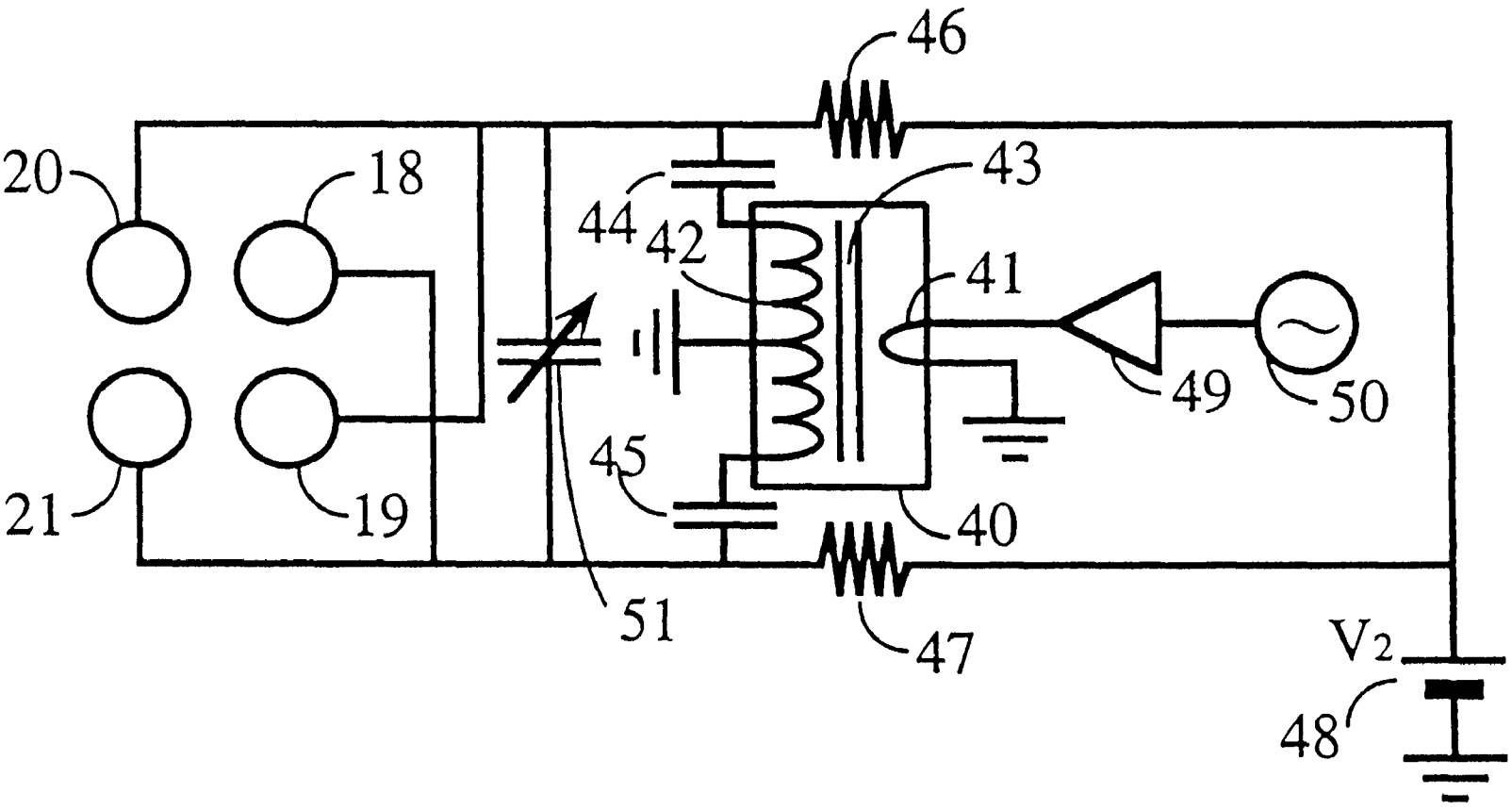
FIG. 4 is a diagram showing one embodiment of an electrical circuit of an end electrode power supply of the mass spectrometer according to this invention.
Figure 5:
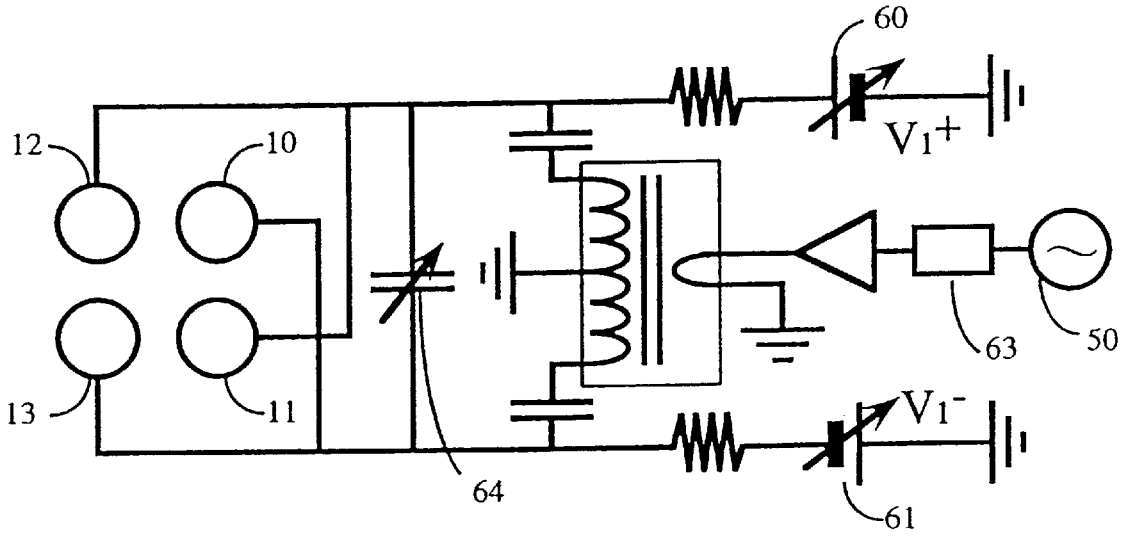
FIG. 5 is a diagram showing one embodiment of an electrical circuit of a filter power supply of the mass spectrometer according to this invention.
Figure 6:
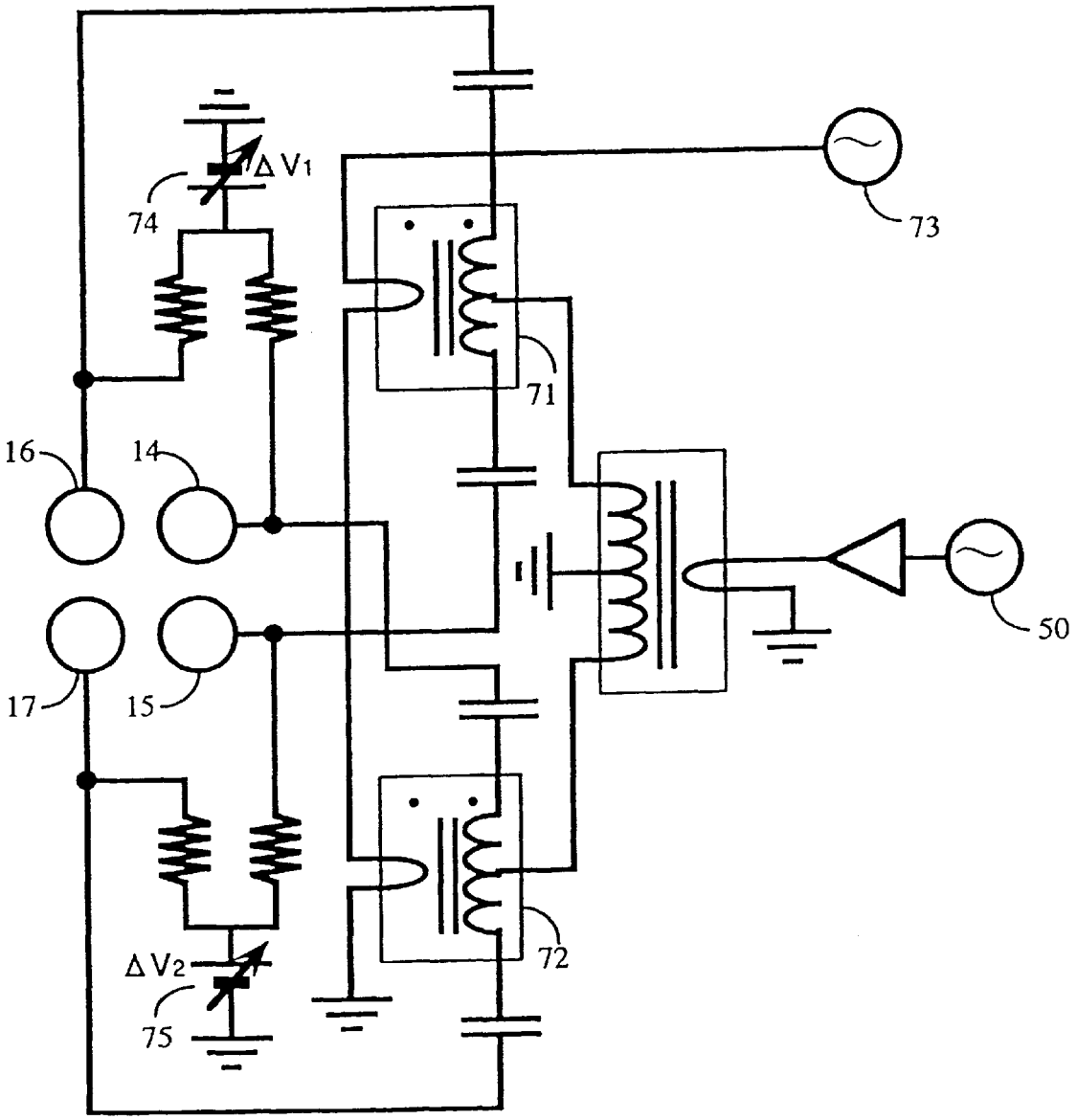
FIG. 6 is a diagram showing one embodiment of an electrical circuit of an analysis power supply of a mass analyzer unit of a mass spectrometer according to this invention.

FIG. 4 shows an example of an electrical circuit of power supply for an end electrode unit of the mass spectrometer according to this invention. FIG. 5 shows an example of an electrical circuit of a power supply for a filter unit of the mass spectrometer according to this invention. FIG. 6 shows an example of an electrical circuit of a power supply for mass analysis of the mass analyzer unit of the mass spectrometer according to this invention. An ion trapping radio frequency voltage, an analysis AC voltage, and an analysis DC voltage is applied to the appropriate parts of the mass filter unit 1, the mass analyzer unit 2 and the end electrode unit 3, according to their respective functions.

FIG. 4 shows an example of a radio frequency voltage applied to electrodes 18, 19, 20 and 21 of the end electrode unit 3. This is an example where an LC resonance circuit is used to obtain a high radio frequency amplitude with a small applied radio frequency voltage. As the electrodes themselves are electrically equivalent to a capacitor, a secondary coil 42 of a step-up transformer 40 is connected to them via capacitors 44, 45 to form the LC circuit. The center of the secondary coil 42 is at ground potential. Radio frequency power of frequency Ω is applied from the primary coil 41. The radio frequency power is generated by a radio frequency oscillator 50 and radio frequency power amplifier 49. A DC voltage $V_2$ is applied between the electrodes and the ground by a power supply 48 via high impedance resistors 46 and 47. The capacitors 44 and 45 insulate the quadrupole electrodes electrostatically from the secondary coil 42 whose center is at ground potential. The resistors 44 and 45 have a resistance equal to or greater than the impedance of the LC resonating circuit at the resonance frequency of the LC resonating circuit.

FIG. 5 is an example of a radio frequency power supply circuit applied to electrodes 10, 11, 12 and 13 of the mass filter unit 1. This circuit is different from the power supply circuit of the end electrode unit 3 (FIG. 4) in the following two points: two power supplies 60 and 61 are used to generate positive and negative voltages $V_1^+$ and $V_1^-$ instead of the voltage $V_2$ so that a quadrupole DC voltage is applied to the electrode pairs; the radio frequency amplitude is variable due to the use of an attenuator 63. Since all other configuration is the same as FIG. 4, a description of the symbols assigned to circuit components and their operation is omitted.

FIG. 6 shows an example of an electrical circuit for the power supply of the mass analyzer unit 2. The mass analyzer unit 2 has a radio frequency power supply 50 to accumulate ions. Another AC voltage is applied to excite a secular motion at frequency Ω, which is supplied from a power supply 73 via the primary coils of transforms 71 and 72, whose secondary coils are connected to the quadrupole electrodes. In order to eject the ions in the direction of the inter-electrode gap to which direction the ion detector 27 is situated, the polarities of the secondary coil voltage of the transformers 71 and 72 are adjusted, as shown in the FIG. 6, so that the auxiliary AC voltage is applied between the nearer electrode pair—14 and 16—and the further electrode pair—15 and 17—, where the relative position is described in relation to the ion detector 27. The radio frequency power supply 50 used for ion accumulation is applied to the electrodes via the center point of the secondary coils of the transformers 71 and 72. The inductance of the secondary coils should be adjusted such that their impedance is less than the impedance of the electrodes at the frequency of the radio frequency power supply 50.

In order to specify the ion ejection direction to the ion detector, and to make the DC electric potential of the mass analyzer unit 2 variable, DC voltages $\Delta V_1$ and $\Delta V_2$ are applied using the DC power supplies 74 and 75 via high resistors. Specifically, when mass analysis is performed, the applied dipole voltage is determined as follows.

The ion oscillation amplitude gradually increases due to resonance oscillation. If the kinetic energy of the ions on the side of the electrode where there is no detector exceeds the depth of the pseudo-potential, the ions are ejected on the side with no detector, and stable and high sensitive ion detection cannot be performed. Therefore, a dipole field is applied so that there is a high potential on the side where there is no detector, and a low potential on the side where here is a detector. The absolute value of the difference $|\Delta V_1-\Delta V_2|$ of these potentials should be arranged to be sufficiently greater than the energy of the ions which have increased during one half period of the oscillatory motion, and, at the same time, sufficiently smaller than the depth of the pseudo-potential that is, $|\Delta V_1-\Delta V_2|<D$. Specifically, the energy ΔV of the ions which have increased in each half period when the ion amplitude is $r_0$, under the condition $q<0.3$ where the pseudo-potential approximation holds, is given by Eqn. (9).

$$\Delta V = \frac{\pi D Q V_{analysis}}{m r_0^2 \omega^2} \quad \text{(Equation 9)}$$

Herein, $V_{analysis}$ is the amplitude of the analysis AC voltage. Using this equation, one should adjust so that $|\Delta V_1-\Delta V_2|>\Delta V$. The polarity of the static voltages $\Delta V_1$ and $\Delta V_2$ should be as follows. If a positive ion is to be detected, a positive voltage should be applied to the two electrodes located further from the ion detector. If a negative ion is to be detected, a negative voltage should be applied to the two electrodes located further from the ion detector. When $q \geqq 0.3$, Eqn. (9) is not valid because the pseudo-potential approximation would not hold. In this case, the differential equations of Eqn. (2) should be solved numerically to calculate the time-dependent trajectory and kinetic energy, so that said static dipole voltages can be adjusted to meet the aforesaid criteria.

The frequencies and phases of the radio frequency voltages applied to the mass filter unit 1, the mass analyzer unit 2 and the end electrode unit 3 must be adjusted to substantially the same value. To this purpose, a common oscillator 50 is used to generate the radio frequency power applied to each unit. In addition, the phases at the electrodes are adjusted to a same value by equalizing the resonance frequencies of the LC resonance circuits of all the units. For this purpose, variable capacitors 51 and 64 are connected in parallel with the electrodes of the end electrode unit 3 and mass filter unit 1, so that they are tuned to the resonance oscillation frequency of the mass filter unit 2.

The procedure for performing mass analysis will now be described. As the following procedure is complex, it is preferably controlled by a computer.

Firstly, one determines a radio frequency voltage and a DC voltage that give a and q values (Eqn. (3)) in the stable region of the mass filter unit for the mass-to-charge ratio of the ion to be detected. When it is desired to detect a plurality of ions, a radio frequency and a DC voltage are applied which place these ions in the stable region. The amplitude of the radio frequency applied to the mass analyzer unit 2 and the end electrode unit 3 is determined to make the q value (Eqn. (3)) of the ion to be detected equal to or less than 0.9 so that the ions can be stably confined. The voltages $V_1^+$, $V_1^-$ and $V_2$ are applied to the mass filter unit 1 and the end electrode unit 3 as shown in FIG. 7 such that ions are allowed to move from the ion source unit to the mass analyzer unit, and such that ions do not leak from the end face of the end electrode unit 3.

Figure 7:
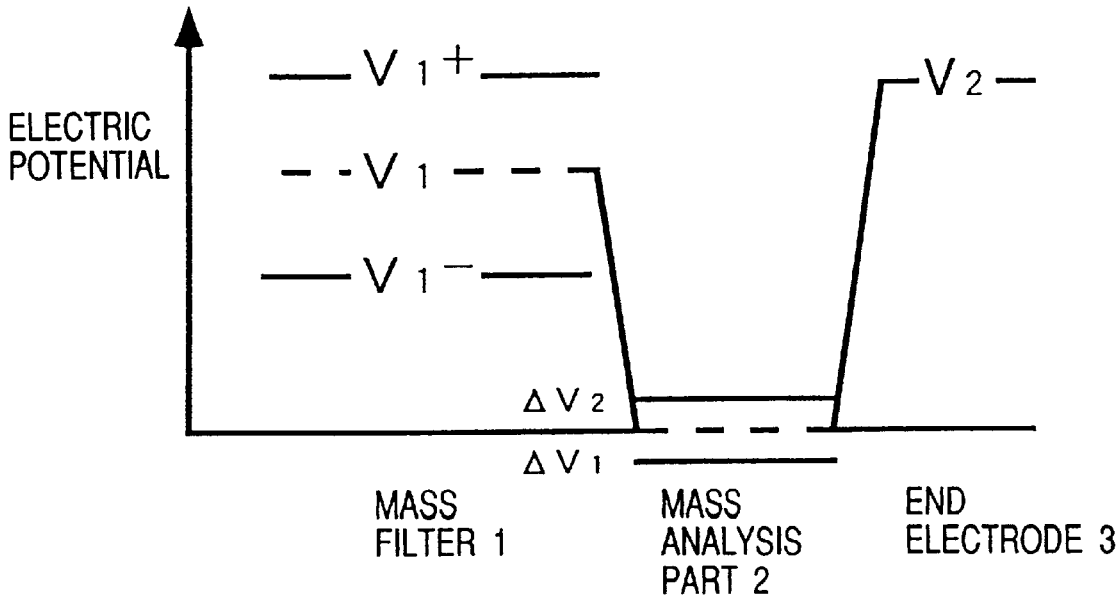
FIG. 7 is a diagram showing one example of the relation between relative magnitudes of DC voltage values applied respectively to a mass filter unit, a mass analyzing unit and an end electrode unit of the mass spectrometer according to this invention.

In FIG. 7, $V_1$ is the DC potential on the center axis of the mass filter unit 1, and is given by $V_1=\{(V_1^+)+(V_1^-)\}/2$. $V_1$ and $V_2$ are chosen to be equal to or less than the depth of the pseudo-potential D of the mass analyzer unit 2 given by Eqn. 7. This prevents ions coming from the mass filter unit 1 from escaping in the direction of the electrodes of the mass analyzer unit 2. Also, it is arranged that $V_2>V_1$ so that ions do not leak from the end face of the end electrode unit 3. The figure shows a case where the ions being detected have positive charge. The polarity should be reversed in the case of detecting ions with negative charge.

Figure 8:
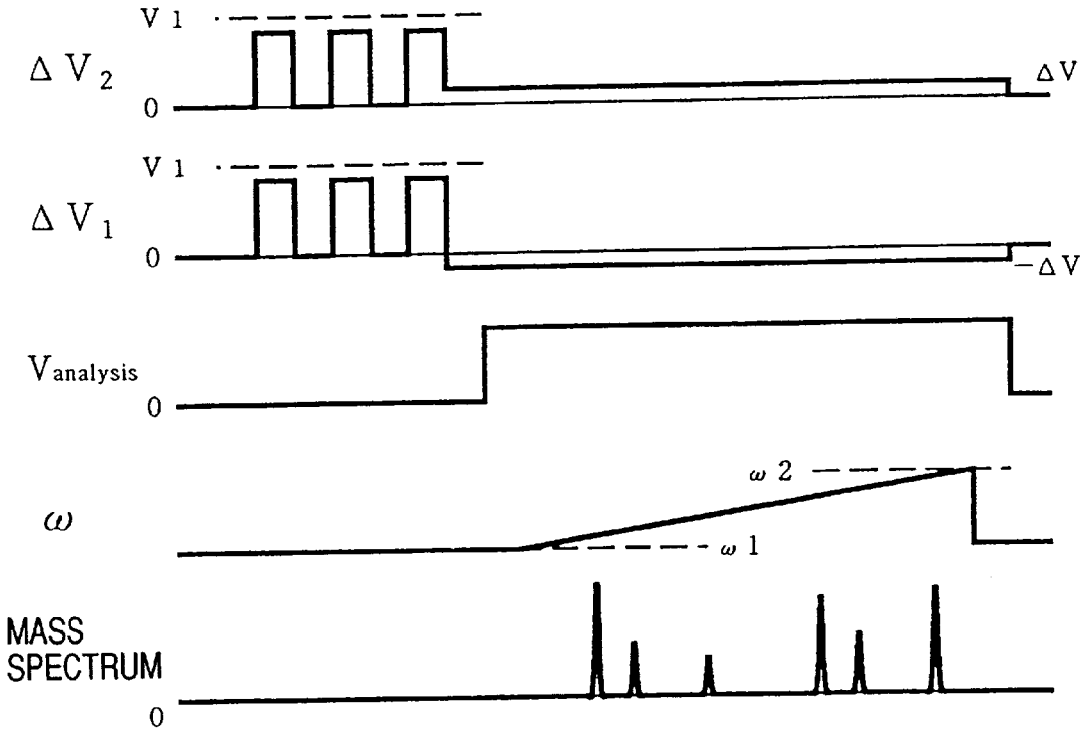
FIG. 8 is a diagram showing one way of operating the mass spectrometer according to this invention.

After the voltage of the mass filter unit 1 has been set, mass analysis is performed in the sequence shown in FIG. 8. Firstly, the mass filter unit 1 removes background ions from the ions coming from the ion source. Next, ions which have passed through the band-pass mass filter unit 1 reach the mass analyzer unit 2. If no other provisions were made, the ions would be reflected by the end electrode unit 3, pass through the mass filter unit 1, return to the ion source and be lost. The DC potential of the mass analyzer unit 2 is therefore varied as a rectangular waveform between two potentials. One of these potentials is set to approximately 0.1V lower than the potential which is effectively required to stop the ions which have passed through the mass filter (referred to hereafter as the higher potential), and the other potential is set to the earth ground potential. If ions are present in the ion trap of the mass analyzer unit when the potential shifts from the higher potential to the ground potential, these ions are trapped inside the trap. While these ions are trapped, they lose their energy due to collision with the helium gas in the mass spectrometer, and they decelerate. The time for which the potential is kept at the ground potential is set so that the ions do not have enough energy to return to the mass filter unit 1 after being cooled. In order to accumulate ions through multiple cycles of the rectangular waveform, the above operation is repeated; the voltages of the power supplies 74 and 75 are simultaneously varied in a rectangular waveform so as to oscillate the DC potential of the mass filter unit.

After ions have accumulated during a certain time interval in the mass analyzer unit 2, the DC potentials $\Delta V_1$ and $\Delta V_2$ in the mass analyzer unit 2 should be set as follows. The potential $\Delta V_1$ of the two electrodes nearer to the detector is set to $-\Delta V$ using $\Delta V$ given by Eqn. (9), and the potential $\Delta V_2$ on the other side is set to $\Delta V$. Mass analysis is then performed by applying an AC field to the quadrupole electrodes while scanning its frequency. When this frequency coincides with the secular motion frequency of the ions, the ions resonate, and are ejected from the inter-electrode gap. The ejected ions are detected by the ion detector 27, e.g. an electron multiplier. The amount of the target ions with a specific mass number in the sample are measured from the spectrum of the number of ejected ions as a function frequency.

Embodiment 2

Figure 9:
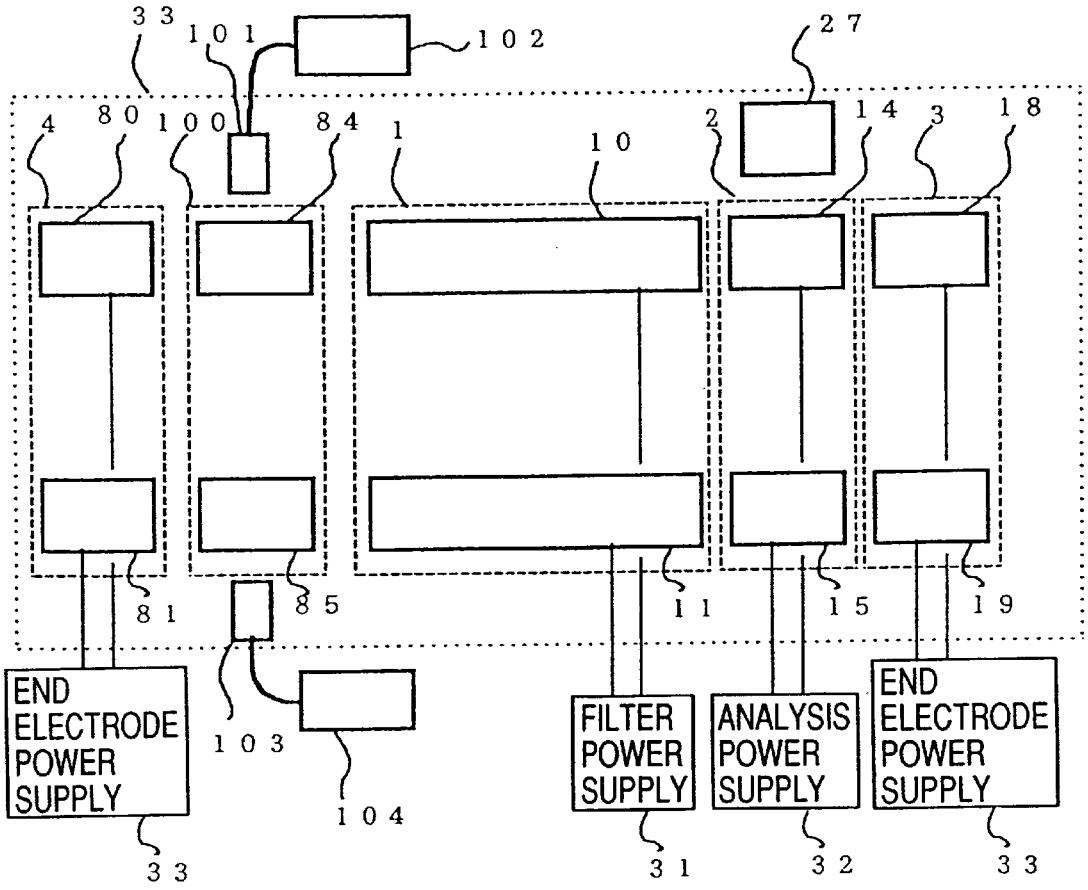
FIG. 9 is a diagram showing one embodiment incorporating an ion-generating quadrupole electrode unit as an ion source unit in the mass spectrometer according to this invention.

In the preceding embodiment, since the ion trapping occurs only intermittently, it is possible that ions to be detected coming from the ion source 25 may be reflected by the end electrode unit 3 and return to the ion source 25 so that they are unexpectedly lost. According to this next embodiment, therefore, instead of the conventional ion source 25 of FIG. 1, an ion source unit 100 is provided comprising quadrupole electrodes 84 to 87 (86 and 87 are not shown in the same manner as in FIG. 1), and an end electrode unit 4 is provided comprising quadrupole electrodes 80 to 83 (82 and 83 are not shown in the same manner as in FIG. 1), as shown in FIG. 9. This arrangement prevents ons from escaping from both ends of the mass spectrometer, and there are no structures on the center axis of the spectrometer, which enables continuous ion injection from the ion source unit to the mass analyzer unit via the filter unit. Other features of the construction are essentially identical to those of FIG. 1, and they have therefore been assigned the same symbols. The power supplies for driving each unit are also the same. Since the ion source unit 100 also has the same type of power supply as the other components, this power supply and its wiring are omitted to simplify the figure.

In the ion source unit 100, sample gas is sprayed and introduced into the quadrupole electrodes by a sample introducing device 104 through a spray 103. An electron gun 101 driven by an electron gun driver 102 irradiate the sample gas with electron beam, thereby ionizing the sample inside the quadrupole electrodes.

In order to guide the generated ions into the mass filter unit 1, the DC potential on the center axis of the quadrupole electrodes of the ion source unit 100 is set higher than that of the mass filter unit 1. The DC potential on the center axis of the quadrupole electrodes of the two end electrode units 3 and 4 is set higher than the DC potential on the center axis of the quadrupole electrodes of the ion source unit 100 in the similar manner as described in FIG. 7. The velocity at which sample ions enter the mass filter unit 1 is determined by the potential difference between the ion source 100 and the mass filter unit. Because these arrangements allow continuous injection and avoids loss of ions to be detected when ions are guided to the mass analyzer 2, the sensitivity and reliability of the mass spectrometer are improved.

The power supply circuits of the ion source unit 100 and the end electrode unit 4 have the same arrangement as those of the end electrode unit in the aforesaid embodiment (FIG. 4), where the DC potentials on the center axis of the electrodes should be set to suitable values according to the criteria given in Embodiment 1, so that ions will be stably trapped inside the multiple quadrupole-structure units.

Embodiment 3

Another embodiment will be described with higher sensitivity.

To improve the sensitivity of the mass spectrometer of the aforesaid two embodiments, it is effective to increase background ion removal efficiency. For this purpose, predetermined background species are removed by one or more additional notch mass filter units that remove ions within a specific mass range, which are inserted between the ion source unit 100 and mass filter unit 1. In this way, it is possible to prevent loss of resolution due to the space charge effect and contamination of the electrodes in the mass filter unit 1.

The additional notch-filter unit for removing specific background ions comprises a linear quadrupole electrode structure identical to the other electrode units, to which a radio frequency voltage for trapping sample ions is applied by a power supply 250. An AC voltage to excite the secular motion of the background ions is applied to each electrodes with a phase difference of a quarter of an oscillation period between neighboring electrodes, the phase being increased successively in clockwise or counterclockwise order among the four electrodes. Since the resultant secular motion of the background ions is spiral, they do not pass through the center of the electrode structure and do not collide with other trapped ions.

Figure 10:
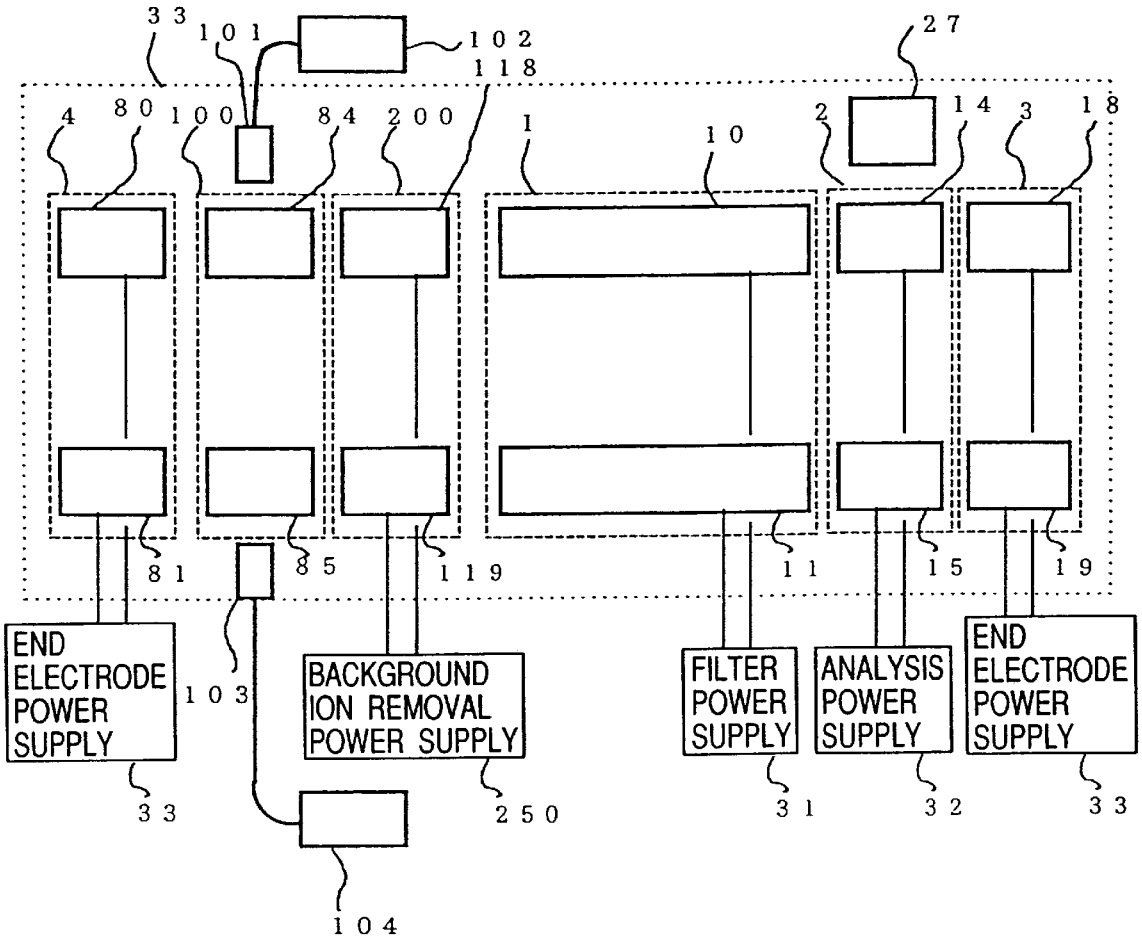
FIG. 10 is a diagram showing one embodiment wherein two background removal filter units are incorporated in the mass spectrometer according to this invention.
Figure 11:
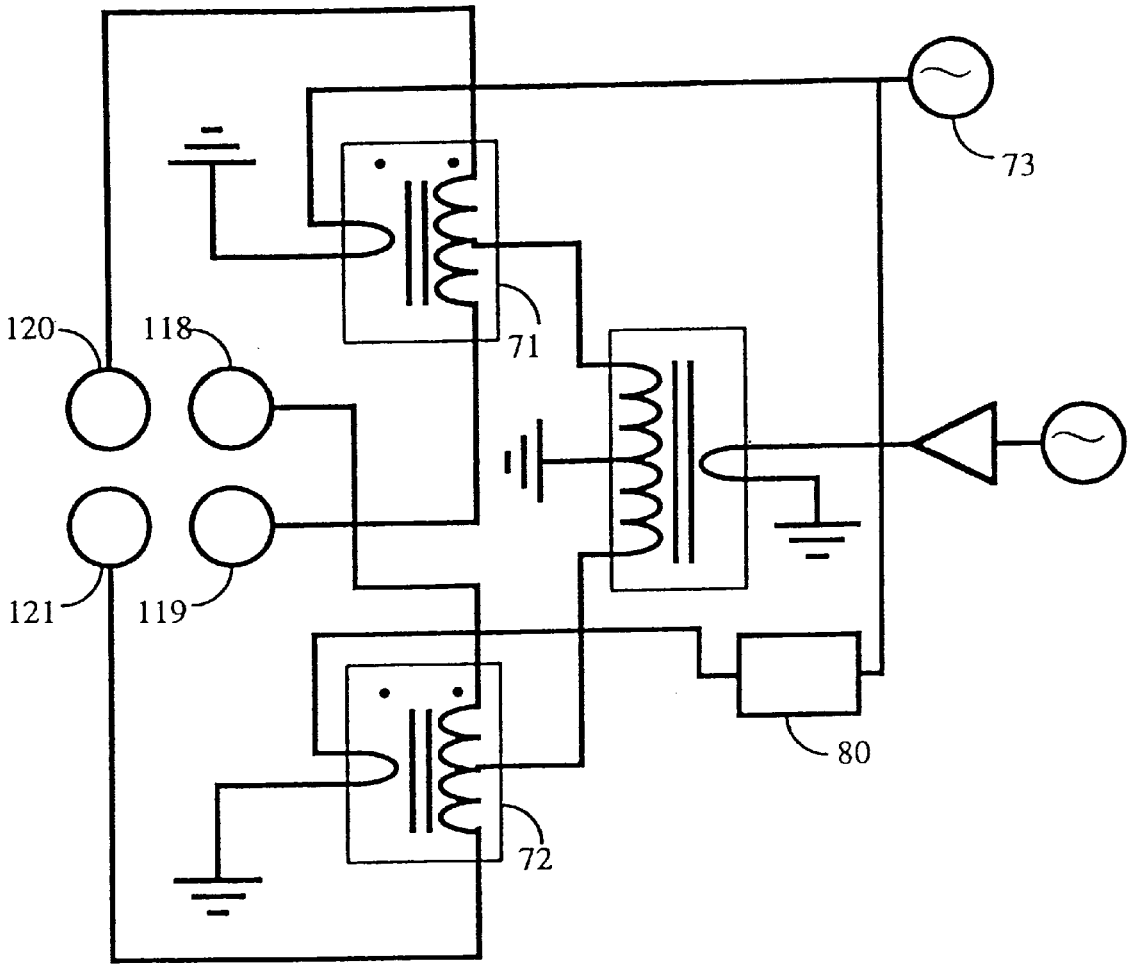
FIG. 11 is a diagram of an electrical circuit for driving the background removal filter unit of the mass spectrometer according to this invention.

FIG. 10 shows an example of a mass spectrometer with one notch filter unit for removing background ions with said quarter-wage excitation method. As can be seen by comparing the second embodiment shown in FIG. 9, a background ion removal filter unit 200 with said quarter-wave excitation method is inserted between the ion source unit 100 and the bass-pass mass filter unit 1. This removal filter unit 200 comprises a linear quadrupole electrodes 118, 119, 120 and 121 as in the mass filter unit 1, but in the figure only 118 and 119 are shown. FIG. 11 shows an example of a power supply circuit 250 for the removal filter unit 200 which applies voltages with phase shifts of one quarter period using a quarter-wage phase shifter 80.

The DC potential along the centers of the electrodes of each component—the end electrode unit 4, the ion source unit 100, the background ion removal filter unit 200, the mass filter unit 1, the mass analyzer unit 2 and the end electrode unit 3—are applied so that ions do not escape from the end electrode units 3 and 4 on both sides, and are also set so that ions can move from the ion source unit 100 to the mass analyzer unit 2 via the mass filter unit 1.

Embodiment 4

Since the mass analysis method of the mass analyzer unit of the first embodiment used the resonance oscillation mode, our fourth embodiment illustrates an example using the mass selective instability mode. Units other than the mass analyzer unit can be ba the same as those described in the first, second or third embodiments. Here, only the difference in the analysis method employed in the mass analyzer unit will be described.

Figure 12:
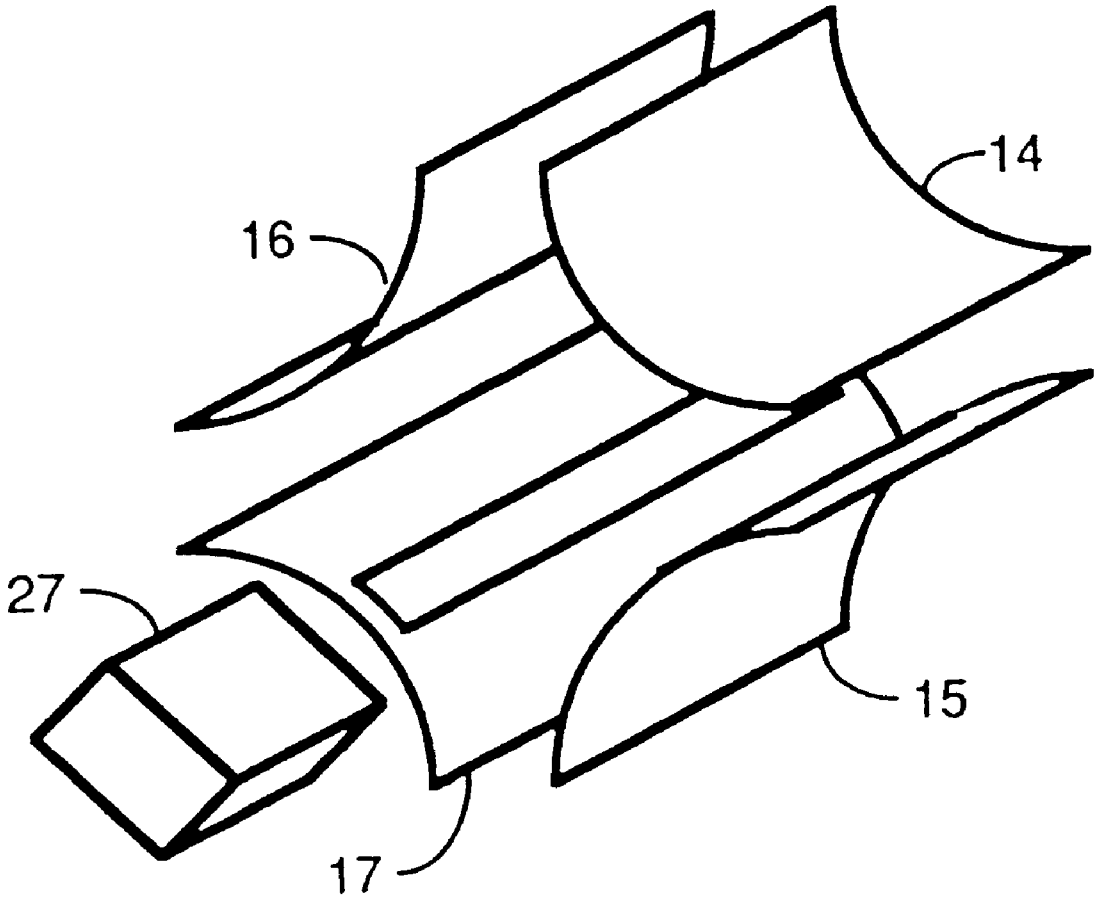
FIG. 12 is a diagram showing the relative positions of an ion removal hole and ion detector in the mass analyzing unit of the mass spectrometer according to this invention.

Firstly, as shown schematically in FIG. 12, a slit in one electrode of the mass analyzer, e.g. electrode 17, is provided to eject ions. The ion detector 27 for detecting ions which have passed through this slit is situated facing the slit.

Figure 13:
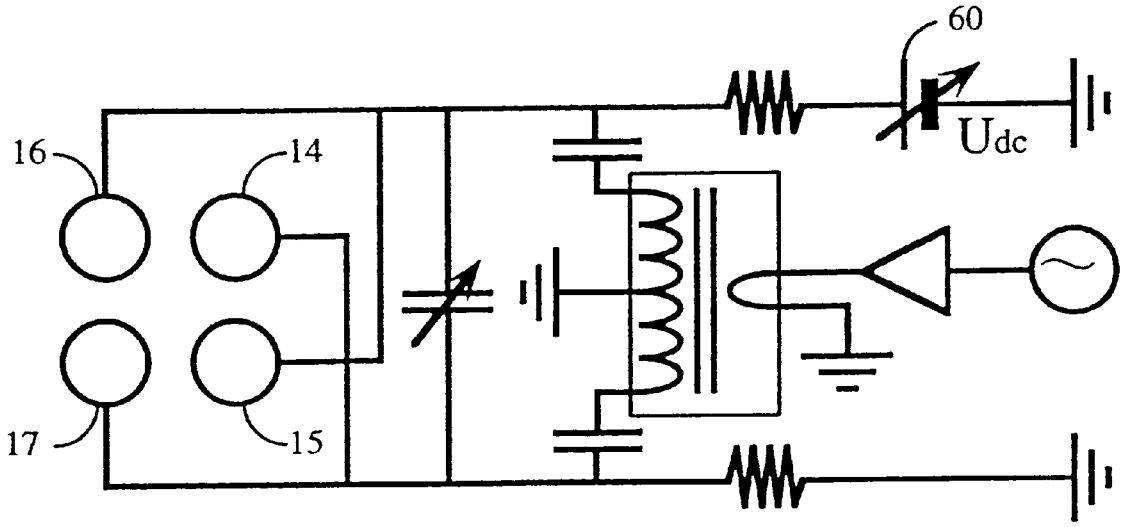
FIG. 13 is a diagram showing one form of an electrical circuit of the analysis power supply of the mass analyzing unit of the mass spectrometer according to this invention.

An example of the electrical circuit for mass selective instability mode is shown in FIG. 13. FIG. 13 shows a radio frequency circuit for trapping ions and a power supply circuit for applying a quadrupole electrostatic voltage Udc. The radio frequency power supply has a capability of scanning the amplitude. When the ion to be analyzed is a positive ion, the polarity of the quadrupole electrostatic voltage is such that ground potential is applied to the electrode comprising the ejecting slit, and a positive voltage is applied to the other electrodes. Conversely, when the ion to be analyzed is a negative ion, the electrode comprising the slit is at ground potential whereas a negative voltage is applied to the other electrodes. By so doing, the ion ejection direction is oriented toward the electrode in which the slit is formed.

An example of operating method of this embodiment will now be described. Firstly, ions to be analyzed are collected in the mass analyzer unit. The method is identical to any one of the methods described in the first, second, or third embodiments. During ions are collected, the DC voltage Udc of mass analyzer unit is set to zero, and the radio frequency voltage is adjusted so that the stability parameter q is situated in the stable region. The ions to be analyzed are thereby stably trapped. When accumulation of ions is finished, the DC voltage Udc is adjusted to a non-zero value for which the parameter a lies in a range wherein ions can be stably trapped, i.e. $0<a<0.23$. Specifically, when the parameters are chosen so that a is of the order of 0.1, the instability direction of the ions can be sufficiently limited while the ions in the stable region an be stably trapped. With these parameters, as the radio frequency voltage is scanned in the direction of increasing amplitude, the ions become unstable in the order of increasing mass-to-charge ratio. Since the mass-to-charge ratio of ions on the stable/unstable boundary is uniquely determined for a specific radio frequency amplitude, the mass-to-charge ratio of the ejected ions can be determined.

Industrial Applicability

According to this invention, the sensitivity of a mass spectrometer can be improved.

What is claimed is:

1. A mass spectrometer comprising:

at least one mass filter unit, each of said at least one mass filter unit comprising a set of quadrupole electrodes forming a linear ion trap for removing background ions, a mass analyzer unit comprising a set of quadrupole electrodes forming a linear ion trap, and an end electrode unit comprising a set of quadrupole electrodes forming a linear ion trap, wherein said at least one mass filter unit, said mass analyzer unit and said end electrode unit are coaxially aligned in a row in the aforesaid sequence, wherein radio frequency voltages and DC voltages are applied to said units of quadrupole electrodes which respectively form said ion traps with radio frequency quadrupole potentials and DC potentials corresponding to their respective functions, wherein said radio frequency voltages which are of identical amplitude and frequency but differing in phase by 180 degrees are applied to diagonally opposite poles of said quadrupole electrodes comprising the respective units of said mass spectrometer, and said radio frequency voltages are variable in each unit, and wherein sample ions are injected through said at least one mass filter unit, accumulated in said mass analyzer unit, and are detected by an ion detector.

2. A mass spectrometer according to claim 1, wherein an auxiliary electrostatic voltage is applied to the quadrupole electrodes of said mass analyzer unit to generate a dipole field between said electrodes so that ions are ejected in a direction of said ion detector.

3. A mass spectrometer according to claim 1, wherein said mass analyzer unit further comprises an AC circuit for applying an AC voltage to two pairs of neighboring electrodes so as to generate a dipole AC field between said electrode pairs, and a DC circuit for applying a DC voltage to said two electrode pairs so as to generate a dipole DC field between said electrode pairs, and wherein said dipole AC field induces ejection of the ions out through a gap between two neighboring electrodes of a pair so that the ions reach said ion detector.

4. A mass spectrometer according to claim 1, wherein the mass analyzer unit further comprises an AC circuit for applying an AC voltage between one pair of opposite electrodes of the four electrodes composing said ion trap so as to generate a dipole AC field between said electrodes, a DC circuit for applying a DC voltage between electrodes to which said AC voltage is applied so as to generate a dipole DC field between said electrodes, and wherein one electrode of said quadrupole electrodes has holes for ejecting ions which are oscillated resonantly to be ejected out of said electrodes by said dipole AC field so that the ions reach said ion detector.

5. A mass spectrometer according to claim 4, wherein said holes provided in said one electrode of said quadrupole electrodes comprises one or more long holes or a plurality of rows of long holes aligned coaxially in a part of the surface of said electrode nearest to a center axis of said ion trap.

6. A mass spectrometer according to claim 5, wherein said holes of said one electrode of said quadrupole electrodes are covered by a fine mesh of small holes formed by a conductor.

7. A mass spectrometer according to claim 5, wherein said one electrode of said quadrupole electrodes comprises a plurality of fine conductor wires stretched on a conducting frame, and the surface formed by said plurality of conductor wires has substantially the same contour as that of the other electrodes.

8. A mass spectrometer according to claim 1, wherein said mass analyzer unit comprises a radio frequency power supply and circuit for applying a radio frequency voltage having an amplitude scanning function for generating a quadrupole radio frequency field between said electrodes and a power supply circuit for applying a DC voltage for generating a quadrupole DC electric field between said electrodes, and wherein one electrode of said quadrupole electrodes has holes for ejecting ions, which have become unstable out of the electrodes so that the ions reach said ion detector.

9. A mass spectrometer according to claim 8, wherein said holes provided in said one electrode of said quadrupole electrodes comprises one or more long holes or a plurality of rows of long holes aligned coaxially in a part of the surface of said electrode nearest to a center axis of said ion trap.

10. A mass spectrometer according to claim 9, wherein said holes of said one electrode of said quadrupole electrodes are covered by a fine mesh of small holes formed by a conductor.

11. A mass spectrometer according to claim 9, wherein said one electrode of said quadrupole electrodes comprises a plurality of fine conductor wires stretched on a conducting frame, and the surface formed by said plurality of conductor wires has substantially the same contour as that of the other electrodes.

12. A mass spectrometer according to claim 1, wherein DC potentials of said at least one mass filter unit and said mass analyzer unit are varied in a time sequence so that ions are accumulated in one of said units to perform desired operation on the ions within said unit according to the respective function of said unit.

13. A mass spectrometer comprising:

one end electrode unit comprising a set of quadrupole electrodes forming a linear ion trap, an ion source unit comprising a set of quadrupole electrodes forming a linear ion trap with ionizing means to create ions within said ion trap of said ion source unit, at least one mass filter unit, each of said at least one mass filter unit comprising a set of quadrupole electrodes forming a linear ion trap for removing background ions, a mass analyzer unit comprising a set of quadrupole electrodes forming a linear ion trap, and an other end electrode unit comprising a set of quadrupole electrodes forming a linear ion trap, wherein said one end electrode unit, said ion source unit, said at least one mass filter unit, said mass analyzer unit and said other end electrode unit are coaxially aligned in a row in the aforesaid sequence, wherein radio frequency voltages and DC voltages are applied to said units of quadrupole electrodes which respectively form said ion traps with radio frequency quadrupole potentials and DC potentials corresponding to their respective functions, wherein said radio frequency voltages which are of identical amplitude and frequency but differing in phase by 180 degrees are applied to diagonally opposite poles of said quadrupole electrodes comprising the respective units of said mass spectrometer, and said radio frequency voltages are variable in each unit, wherein electrostatic potentials of at least one of said one and other end electrode units are adjusted so that the ions are confined stably within said ion source unit, said at least one mass filter unit, or said mass analyzer unit of said mass spectrometer, wherein a sample to be analyzed is injected from outside the quadrupole electrodes of said ion source unit so as to create sample ions to be analyzed within said ion trap of said ion source unit, and wherein, after said ions have accumulated in said mass analyzer unit via said at least one mass filter unit, said ions are detected by an ion detector.

14. A mass spectrometer according to claim 13, wherein the radio frequency voltages and DC voltages applied to the ion trap electrodes of at least one of said units quadrupole electrodes are set to values at which sample ions to be analyzed can be stably trapped, wherein an auxiliary AC voltage different from said radio frequency voltages is applied to said ion trap, wherein the frequency of said AC voltage corresponds to a resonance oscillation frequency of an ion having a specific mass to charge ratio, and wherein said AC voltage is applied so that the phase differs by one quarter of an oscillation period between each neighboring electrodes of the quadrupole electrodes, so that undesired ions are ejected out of the unit of quadrupole electrodes in a spiral motion.

15. A mass spectrometer according to claim 13, wherein a trapping quadrupole field in each unit is created by a pair of voltages of identical amplitude and frequency but differing in phase by 180 degrees which are applied to two pairs of diagonally opposite electrodes of each of said units of quadrupole electrodes composing said mass spectrometer, and wherein the amplitudes of the applied radio frequency and DC voltages in a respective unit are variable independently of those of other units.

16. A mass spectrometer according to claim 13, wherein DC potentials of said at least one mass filter unit and said mass analyzer unit are varied in a time sequence so that ions are accumulated in one of said units to perform desired operation on the ions within said unit according to the respective function of said unit.

17. A mass spectrometer according to claim 13, wherein an auxiliary electrostatic voltage is applied to the quadrupole electrodes of said mass analyzer unit to generate a dipole field between said electrodes.

18. A mass spectrometer according to claim 13, wherein said mass analyzer unit further comprises an AC circuit for applying an AC voltage to two pairs of neighboring electrodes so as to generate a dipole AC field between said electrode pairs, and a DC circuit for applying a DC voltage to said two electrode pairs so as to generate a dipole DC field between said electrode pairs, and wherein said dipole AC field induces ejection of the ions out through a gap between two neighboring electrodes of a pair so that the ions reach said ion detector.

19. A mass spectrometer according to claim 13, wherein the mass analyzer unit further comprises an AC circuit for applying an AC voltage between one pair of opposite electrodes of the four electrodes composing said ion trap so as to generate a dipole AC field between said electrodes, a DC circuit for applying a DC voltage between electrodes to which said AC voltage is applied so as to generate a dipole DC field between said electrodes, and wherein one electrode of said quadrupole electrodes has holes for ejecting ions, which are oscillated resonantly to be ejected out of said electrodes by said dipole AC field so that the ions reach said ion detector.

20. A mass spectrometer according to claim 19, wherein said holes provided in said one electrode of said quadrupole electrodes comprises one or more long holes or a plurality of rows of long holes aligned coaxially in a part of the surface of said electrode nearest to a center axis of said ion trap.

21. A mass spectrometer according to claim 20, wherein said holes of said one electrode of said quadrupole electrodes are covered by a fine mesh of small holes formed by a conductor.

22. A mass spectrometer according to claim 20, wherein said one electrode of said quadrupole electrodes comprises a plurality of fine conductor wires stretched on a conducting frame, and the surface formed by said plurality of conductor wires has substantially the same contour as that of the other electrodes.

23. A mass spectrometer according to claim 13, wherein said mass analyzer unit comprises a radio frequency power supply and circuit for applying a radio frequency voltage having an amplitude scanning function for generating a quadrupole radio frequency field between said electrodes and a power supply circuit for applying a DC voltage for generating a quadrupole DC electric field between said electrodes, and wherein one electrode of said quadrupole electrodes has holes for ejecting ions, which have become unstable, out of the electrodes so that the ions reach said ion detector.

24. A mass spectrometer according to claim 23, wherein said holes provided in said one electrode of said quadrupole electrodes comprises one or more long holes or a plurality of rows of long holes aligned coaxially in a part of the surface of said electrode nearest to a center axis of said ion trap.

25. A mass spectrometer according to claim 24, wherein said holes of said one electrode of said quadrupole electrodes are covered by a fine mesh of small holes formed by a conductor.

26. A mass spectrometer according to claim 24, wherein said one electrode of said quadrupole electrodes comprises a plurality of fine conductor wires stretched on a conducting frame, and the surface formed by said plurality of conductor wires has substantially the same contour as that of the other electrodes.

* * * * *